US005711233A

United States Patent [19]

Martin et al.

[11] Patent Number: 5,711,233

[45] Date of Patent: Jan. 27, 1998

[54] PROCESS AND ARRANGEMENT FOR THE TREATMENT OF SOLID COMBUSTION RESIDUES IN A COMBUSTION INSTALLATION, IN PARTICULAR IN A WASTE INCINERATION PLANT

[75] Inventors: Johannes J. E. Martin; Oliver Gohlke; Walter J. Martin, all of Munich, Germany

[73] Assignee: Martin GmbH fuer Umwelt- und Energietechnik, Munich, Germany

[21] Appl. No.: 612,758

[22] Filed: Mar. 8, 1996

[30] Foreign Application Priority Data

Mar. 9, 1995 [DE] Germany ..... 195 08 488.8

[51] Int. Cl.[6] ..... F23J 1/00

[52] U.S. Cl. ..... 110/165 R; 110/170; 110/344; 34/401

[58] Field of Search ..... 110/165 R, 170, 110/171, 346; 34/69, 164

[56] References Cited

U.S. PATENT DOCUMENTS

| | | | |
|---|---|---|---|
| 3,734,037 | 5/1973 | Martin | 110/165 R |
| 4,503,783 | 3/1985 | Musschoot | 110/165 R |
| 4,520,738 | 6/1985 | Takehara | 110/171 |
| 4,976,206 | 12/1990 | Steiner et al. | 110/171 |
| 5,082,572 | 1/1992 | Schmidt | 210/744 |
| 5,331,746 | 7/1994 | Martin et al. | 34/401 |

FOREIGN PATENT DOCUMENTS

| | | |
|---|---|---|
| 0151746 | 12/1984 | European Pat. Off. . |
| 0304412 | 7/1988 | European Pat. Off. . |
| 524207 | 4/1928 | Germany . |
| 711606 | 4/1938 | Germany . |
| 2812003 | 3/1978 | Germany . |

*Primary Examiner*—Henry A. Bennett
*Assistant Examiner*—Pamela A. O'Connor
*Attorney, Agent, or Firm*—McAulay Fisher Nissen, Goldberg & Kiel, LLP

[57] ABSTRACT

The arrangement for treating combustion residues of a combustion installation comprises an ash discharger into which opens a fall shaft, into which the solid combustion residues fall from a furnace grate. The ash is conveyed from the ash discharger into the discharge shaft via a diagonally ascending push-out chute by a push-out ram whose operating rate is so adjusted that the ash is piled up in the fall shaft in a tower formation reaching above the liquid level. Fresh water or a chemical is introduced into the discharge shaft via an inlet. The ash discharger water present in the ash discharger and charged with fine particles is drained into a hermetically sealed settling tank via a draw-off duct. Ash discharger water, with which a chemical can be mixed via another line, is fed from the upper region of the settling tank by a pump via a return line to spray nozzles which are arranged in the upper region of the fall shaft. Ash discharger water which is enriched with solids particles is drawn off from the bottom of the settling tank via another pump which is arranged in an outlet line proceeding from the settling tank. This is effected at a rate such that solids particles having a diameter of up to 2 mm are carried away with the ash discharger water which is drawn off through the draw-off duct.

27 Claims, 2 Drawing Sheets

PROCESS AND ARRANGEMENT FOR THE TREATMENT OF SOLID COMBUSTION RESIDUES IN A COMBUSTION INSTALLATION, IN PARTICULAR IN A WASTE INCINERATION PLANT

BACKGROUND OF THE INVENTION a) Field of the Invention

The invention is directed to a process for treating solid combustion residues in a combustion installation, in particular in a waste incineration plant, with a furnace grate and an ash discharger which is connected thereto and is filled with liquid and has a fall shaft and a ram extractor or push-out ram and which discharges combustion residues via an ascending push-out chute. The invention is also directed to an arrangement for carrying out the process.

b) Description of the Related Art

In a known process of the type mentioned above, the combustion residues occurring at the end of a furnace grate in a combustion installation, especially ashes and cinders, are discharged by means of a push-out ram via an ascending push-out chute by an ash discharger which is filled with water. A fall shaft proceeding from the end of the combustion grate penetrates into the ash discharger and accordingly closes the furnace space in an airtight manner. In this so-called nonwaste-water concept, in which the ash discharger is only supplied with just enough fresh water that the ashes which are moistened thereby are discharged, there occurs in the ash discharger and in the water located therein an equilibrium concentration with respect to numerous substances and compounds adhering in the residues, e.g., salt, so that it is not possible to reduce the concentration of these substances and compounds. This results in unsatisfactory characteristics of the ash with respect to disposability or further processing in the form of construction materials.

In another known ash washing process, water is drawn off in the rear region of an ash discharger via a run-off and fresh water is fed into the front discharge shaft. In so doing, soluble components adhering to the ash are removed by the water and are extracted from the ash discharger in the form of sludge behind the rear wall of the fall shaft. Since these soluble components must submerge to the rear under the lower edge of the fall shaft, it is understandable that a considerable portion of these components detached by the water are discharged along with the ashes via the push-out chute. Therefore, the characteristics of the ashes with respect to ease of disposal or further processing to form construction materials are still not improved.

It is known from EP-C-0 304 412 to subject combustion residues at least to an alkaline washing and thereupon also, advantageously, to an acidic washing in order to remove not only the water-soluble components but also the heavy metals loosely bonded to the ash. This requires a relatively elaborate apparatus which is arranged downstream of the ash discharger.

OBJECT AND SUMMARY OF THE INVENTION

The primary object of the present invention is to avoid expenditure on apparatus as far as possible while at the same time enabling a treatment of the solid combustion residues resulting in satisfactory ash characteristics with respect to ease of disposal and further processing to form construction materials.

According to the present invention, this object is met proceeding from a process of the type mentioned above in that the washing of the combustion residues is effected in the ash discharger in which the combustion residues are built up in the fall shaft by suitable regulation of the discharge rate, the washing liquid flowing downward through these combustion residues. The solid combustion residues are preferably built up beyond the water level in the fall shaft.

As a result of the washing of the solid combustion residues already in the ash discharger, a large portion of the known expenditure on apparatus is avoided. The decisive improvement compared with the washing of ash by means of water in the conventional sense consists in that the solid combustion residues are built up or piled up in a tower formation in the ash discharger so that a substantially longer period of action is available for the washing liquid and, in view of this fact alone, improvements can be noticed over the conventional ash washing even when the washing liquid comprises only water. The combustion residues are accordingly extensively freed from pollutants in spite of the low expenditure on apparatus so that they can be disposed of in dumps or processed to form construction materials.

A substantial improvement with respect to the separation of heavy metals is achieved in a further development of the invention in that a chemical, preferably acid, e.g., hydrochloric acid or phosphoric acid, is used for washing, wherein the building up or piling up of the solid combustion residues in a tower formation, especially so as to reach beyond the surface of the liquid, provides particularly favorable conditions for washing by means of a chemical, especially acid, since this tower formation of the combustion residues provides long paths on which the washing liquid can proceed through these combustion residues and accordingly provides long dwelling periods which ensures that heavy metals will be satisfactorily washed out of the solid combustion residues without additional vessels or reactors. Due to the piling up of the combustion residues above the level of liquid, the washing liquid or chemical first comes into contact with dry combustion residues, namely in the fall shaft, in which no particular mechanical action takes place on the walls of the fall shaft, so that materials can be used for the construction of the fall shaft which are suitable for use with stronger acids. By the time the washing liquid or chemical trickles through the combustion residues and reaches the surface of the liquid, below which the push-out ram is located, this washing liquid, when acidic, is neutralized by the alkaline combustion residues to the extent that there is no longer a risk of a corrosive attack on those portions of the ash discharger which are located in the liquid and which are subject to particularly high mechanical wear, so that these portions need not be manufactured from acid-resistant material at an impractical cost. Thus, the tower formation of the solid combustion residues within the fall shaft reaching above the surface of the liquid is an essential prerequisite for the use of chemicals, in particular acids, within the ash discharger.

As a result of a further development of the invention in which fresh water or a chemical, in particular bases such as sodium hydroxide or phosphates, e.g., the salts of phosphoric acid, is fed at the discharge end of the ash discharger in a counterflow to the washing liquid flowing down through the combustion residues, the bonding of possible residual pollutants in the combustion residues is improved and the components which are detached or released during the washing process and which can settle on the solid combustion residues again are washed out. In addition, it is also ensured that the lower part of the ash discharger is not stopped with fine combustion residues which would prevent coarser combustion residues from being pushed out.

Moreover, it can also be ensured in this way that those parts of the ash discharger which cannot be manufactured from acid-resistant material for reasons pertaining to resistance to wear do not come into contact with the acidic washing liquid, if used, since such a situation is prevented by washing liquid in the form of fresh water or a chemical which is fed in the counterflow.

In a further development of the invention, the ash discharger water which is present in the ash discharger and which is charged with washed out products is drawn off at the liquid surface adjusted at the lower end of the fall shaft within the region defined by the fall shaft or is drawn out of the ash discharger in order for the sludge which occurs in the washing process and comprises organic materials, water-soluble pans and heavy metal components to be reliably removed from the ash discharger. In this way, the ash discharger water or sludge is reliably drawn off into a draw-off duct, since this ash discharger water which is charged with fine particles need no longer flow under the rear wall of the fall shaft into the rear region of the ash discharger, where this sludge was formerly drawn off in the conventional ash washing processes. This manner of drawing off the occurring sludge is particularly advantageous when using washing liquid in a counterflow proceeding from the push-out end, since the two flows meet within the ash discharger in the region of the surface of the liquid at the lower end of the fall shaft, so that the components which have already been separated by the washing liquid trickling down in the fall shaft and those components which have settled on the combustion residues again can be carried off and rinsed away by the washing liquid introduced at the push-out end. As a result of this advantageous manner of drawing off sludge comprising organic materials, water-soluble components and heavy metal components, wherein in an advantageous further development of the invention the draw-off rate is regulated so as to enable solid particles with particle diameters of up to 2 mm to be carried away, it is ensured that fine particles of ash comprising particles of up to 2 mm will also be drawn off. This is advantageous because these fine particles contain a particularly high concentration of pollutants and, above all, heavy metals.

In a further development of the invention, this ash discharger water which is drawn out of the ash discharger and is charged with washed out products of the type mentioned above can be fed either to a waste gas purification device arranged downstream of the combustion process or to a washing stage for neutralizing acidic waste gases formed in the combustion process. With respect to the first possibility, this ash discharger water is sprayed into the waste gas flow, wherein acidic waste gases can be neutralized on the one hand and the water component can be expelled on the other hand. The dry component is fed to the other filter dusts which have been separated out of the waste gas of the combustion installation. The second possibility consists in the use of the ash discharger water for neutralizing acidic waste gases in wet scrubbers.

Depending upon the chemical composition of the combustion residues and the washing liquid employed, it may be advantageous, according to another development of the invention, to feed at least a portion of the drawn off ash discharger water back into circulation in the fall shaft for washing the combustion residues.

The combustion residues falling through the furnace grate can be advantageously mixed with the ash discharger water drawn off at the lower end of the fall shaft or from the ash discharger so that they need not be quenched in an additional special ash discharger, which would be necessary if they were reintroduced into the combustion process together with other still combustible components washed out in the ash discharger, since it is not possible to return the combustion residues which have fallen through the furnace grate directly to the delivery chute because of a possible risk of fire.

The quantity of washing liquid fed into the region of the upper end of the fall shaft is preferably 0.2 to 20 $m^3$ per ton of combustion residues, while the quantity of washing liquid fed in the counterflow at the push-out end of the ash discharger is preferably 0.2 to 4 $m^3$ per ton of combustion residues.

The arrangement for carrying out the process is characterized by an ash discharger in which a device is provided in the region of the upper end of the fall shaft for supplying washing liquid, which device distributes the washing liquid over the entire cross section of the fall shaft. In this way, the washing liquid trickles through the combustion residues in a uniform manner. This washing liquid can be circulated ash discharger water and/or a chemical, preferably an acid.

The device for supplying washing liquid can advantageously comprise spray nozzles which are provided in the side walls of the fall shaft. This construction not only permits a uniform trickling of washing liquid through the combustion residues but also makes it possible for the solid combustion residues to fall through in a trouble-free manner.

On the other hand, the device for supplying washing liquid can also comprise perforated pipes traversing the fall shaft. The holes in the pipes act as spray nozzles. Since only a few pipes are needed, there is practically no obstacle in the falling path of the combustion residues.

In a further development of the invention, the parts of the ash discharger subject to particular mechanical stress by the push-out ram are formed of a material which is wear-resistant but not acid-resistant and the parts which are subject to less mechanical stress, in particular the walls of the fall shaft, are formed of an acid-resistant material resulting in an economical ash discharger which is particular suitable for use with an acidic washing liquid.

Spray nozzles for fresh water or washing liquid are provided at the push-out side of the ash discharger so that an additional washing liquid can be fed in a simple manner in the counterflow to the ash to be discharged, these spray nozzles enabling a uniform distribution of the liquid to the combustion residues located on the push-out chute.

In a further development of the invention, the ash discharger is connected with a hermetically sealed sedimentation tank or settling tank via a draw-off duct proceeding from the surface of the liquid within the fall shaft or within the ash discharger, so that the ash discharger water occurring in the washing process, including fine particles floating on the surface, can be drawn off in a reliable and controllable manner without the risk of secondary air penetrating into the furnace space which is operated at below-atmospheric pressure.

The settling tank is advisably connected via vacuum locks with the collecting hoppers for the combustion residues falling through the furnace grate since this makes it possible to quench these combustion residues in a simple manner without additional ash dischargers.

The invention is explained more fully in the following with reference to embodiment examples of an arrangement for carrying out the process, which arrangement comprises an ash discharger.

DESCRIPTION OF THE PREFERRED EMBODIMENTS

Figure 1:
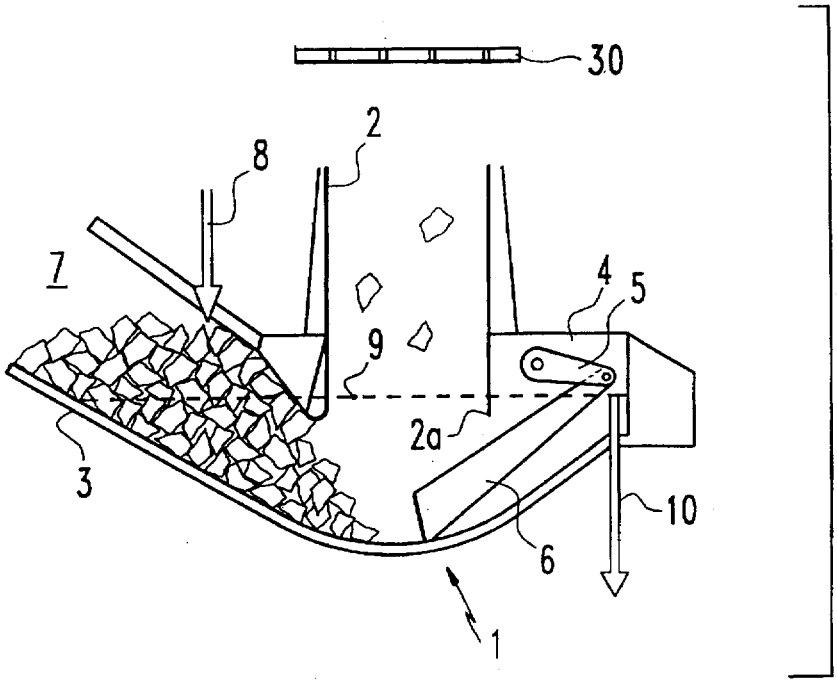
PRIOR ART Fig.1
FIG. 1 shows an ash discharger according to the prior art.

FIG. 1 shows a known ash discharger, designated in its entirety by 1, which has a fall shaft 2, a push-out chute 3, and a push-out ram 6 which is articulated at a driven swivel arm 5 in the rear region 4 of the ash discharger and pushes the ash falling from a furnace grate 30 into a push-out shalt 7 via an ascending push-out chute 3. A constant liquid level 9 is maintained in the ash discharger 1 by means of fresh water which is supplied via an inlet 8, this liquid level 9 being adjusted at a height such that the lower edge 2*a* of the fall shaft 2 is immersed in the water. Although an ash wash is effected in this known ash discharger by means of water, wherein waste water is drawn off via an outlet 10 at the rear end 4 of the ash discharger 1, a large proportion of fine components which do not submerge under the lower edge of the fall shaft is discharged into the discharge shaft together with the ashes, which is the cause of the unsatisfactory ash characteristics mentioned in the introduction.

Figure 2:
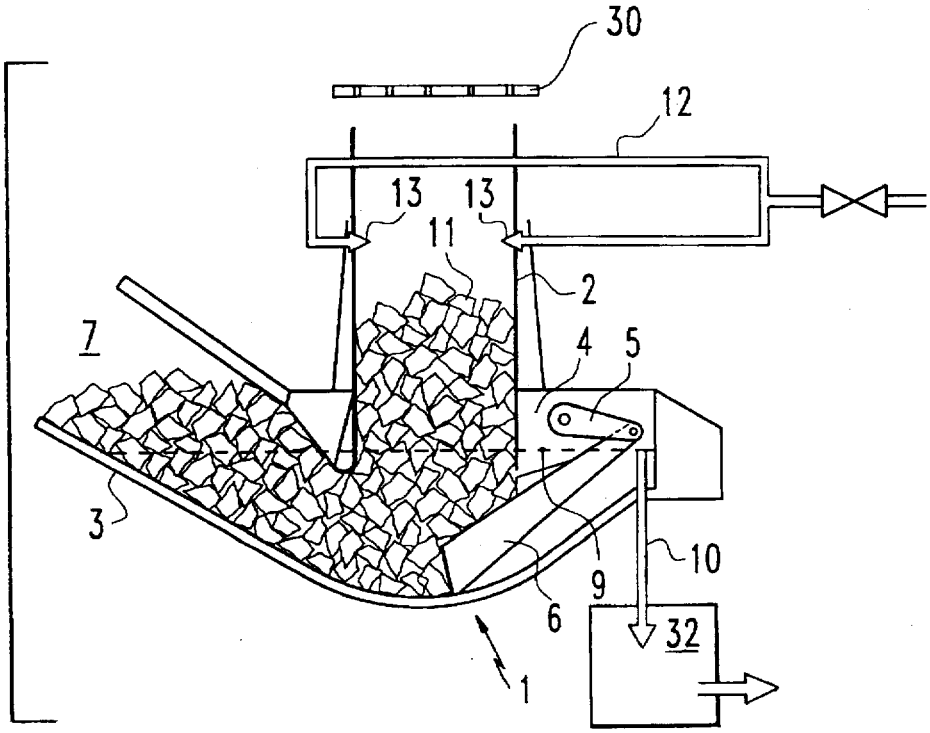
FIG. 2 shows a first embodiment form of an arrangement for carrying out the process according to the invention.
Figure 3:
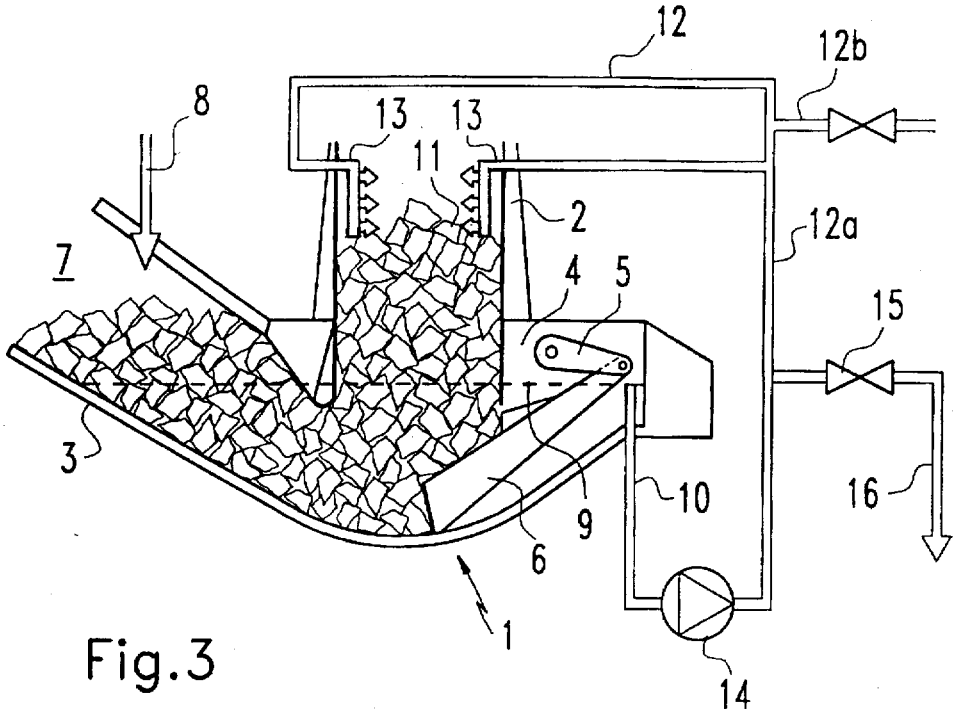
FIG. 3 shows another embodiment form of an arrangement according to the invention.
Figure 4:
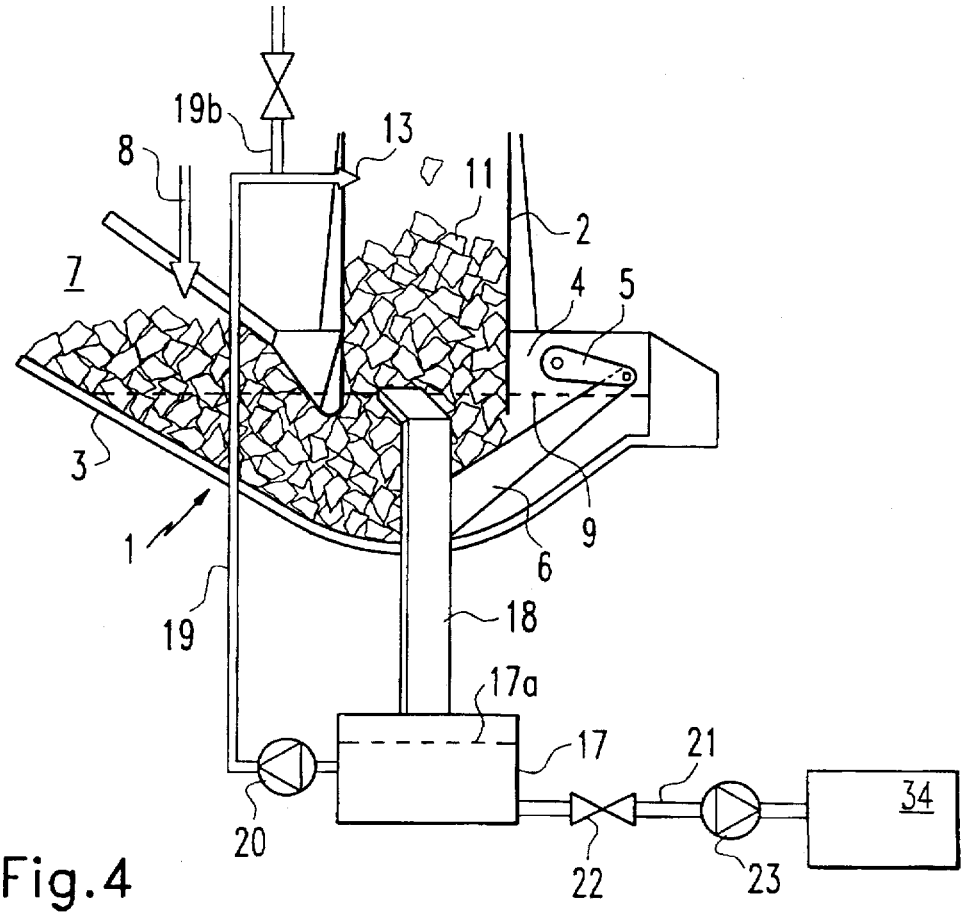
FIG. 4 shows a preferred embodiment form of the arrangement according to the invention.

The views of the arrangements shown in FIGS. 2 to 4 show one of the essential features of the invention which consists in that the ash, designated by 11, is built up in a tower formation in the ash fall shaft 2, this tower formation preferably reaching far above the liquid level 9 in the fall shaft 2. It is noted at this point that all structural component parts corresponding to those in the ash discharger according to the prior art have the same reference numbers as in FIG. 1.

As regards the substantial structural component parts of the ash discharger 1, the relationships shown in the embodiment form according to FIG. 2 are identical to those shown in FIG. 1. Therefore, only differences between the two embodiment forms will be discussed. In the embodiment form shown in FIG. 2, the push-out output of the push-out ram 6 is regulated in such a way that the ash 11 forms a vertical tower in the fall shaft 2. The washing liquid, which can be water and/or a chemical, preferably an acid, is fed via a circular line 12 which communicates with spray nozzles which are provided in the side walls of the fall shaft 2. These spray nozzles 13 enable the washing liquid to trickle down through the ash 11 forming a tower within the fall shaft 2 over the entire cross section of the fall shaft 2. The ash discharger water which is charged with washed out products is drawn off via a draw-off line 10 which proceeds from the rear region 4 of the ash discharger 1.

FIG. 3 shows a modification of the embodiment form according to FIG. 2, while the essential parts of the ash discharger have the same construction. In this embodiment form, a washing liquid, which can be water or a chemical, in particular a base or phosphate compounds, is supplied via the inlet 8 in the discharge shaft 7 of the ash discharger 1. The ash discharger water which is drawn off from the rear space 4 of the ash discharger via the draw-off line 10 and which is charged with washed out products is pumped into the circular line 12 leading to the spray nozzles 13 by a pump 14 via a line 12*a*. In so doing, a portion of this charged liquid is diverted via a valve 15 and another line 16 in order to maintain the liquid level 9 in the ash discharger 1 at a determined level on the one hand, this being necessary because of the supply of liquid through the inlet 8, and, on the other hand, in order to keep the concentration of entrained sludge pans, salts and other pollutants from increasing excessively. In this embodiment form, circulated ash discharger water, to which a chemical, preferably an acid, can be added via a line 12*b* opening into the circular line 12, trickles through the ash 11 which is built up in a tower formation in the fall shaft 2. The concentration of received pollutant particles is maintained at a determined level by the constant supply of liquid at the inlet 8 and the discharge of ash discharger water via the valve 15 and the line 16.

In the preferred embodiment form of the arrangement for carrying the process which is shown in FIG. 4, fresh water or a chemical, preferably a base or a substance from the group of phosphates, is introduced into the discharge shaft 7 via the inlet 8. As in the embodiment form shown in FIG. 3, a chemical, preferably an acid, and/or circulated ash discharger water is used to trickle through the ash 11 which is built up in a tower formation in the fall shaft 2. The ash discharger water is removed from a settling tank 17 which is closed in an airtight manner and communicates with the ash discharger 1 via a draw-off duct 18 which proceeds from a region at the height of the liquid level 9 within the fall shaft 2 or from the ash discharger located below the latter. The return line 19 which leads to the spray nozzles 13 in the upper region of the fall shaft 2 is supplied by means of a pump 20 which sucks the ash discharger water out of the settling tank 17 at a liquid level 17*a* which is adjusted close to that point so as to suck out as few solid particles as possible. A chemical, preferably an acid, can be fed to the spray nozzles 13 in addition to the ash discharger water by means of a line 19*a* opening into the return line 19. However, the chemical can also be supplied instead of the ash discharger water if required by the treatment of the combustion residues. Liquid is drawn out from the bottom of the settling tank 17, where the ash discharger water is considerably enriched by the settling solids particles, via an outlet line 21 in which is arranged a shut-off valve 22. Valve 22 may be a vacuum lock. The amount drawn off is regulated via the pump 23 in such a way that a draw-off rate is achieved in the draw-off duct 18 connected with the liquid level 9 within the fall shaft 2 such that only solids particles up to a particle size of 2 mm are drawn off. The drawn off particles may be collected in collecting hopper 34. The particles exceeding this diameter are pushed out along with the other coarse ash parts via the push-out chute 3 by the push-out ram 6.

In each of the embodiments of the invention discussed herein, it is understood that the fluid removed from the ash discharger 1 through the corresponding draw-off line may be routed into an additional device 32. Referring to FIG. 1, draw-off line 10 is connected to device 32. Line 16 of FIG. 3 and line 21 of FIG. 4 may be similarly connected to device 32. In any of the embodiments, device 32 is a waste gas purification device where the fluid removed is used as washing fluid for gases to be purified or is a device which provides a washing stage.

In each of the embodiments of the invention disclosed herein, nozzles 13 may be replaced by perforated pipes traversing the fall shaft as illustrated in FIG. 3.

While the foregoing description and drawings represent the preferred embodiments of the present invention, it will be obvious to those skilled in the art that various changes and modifications may be made therein without departing from the true spirit and scope of the present invention.

What is claimed is:

1. In a process for treating solid combustion residues in a combustion installation such as in a waste incineration plant, having a furnace grate and an ash discharger which is connected thereto and is filled with liquid and having a fall shaft and a push-out ram and which discharges combustion residues through the means of an ascending push-out chute, the improvement comprising the step of:

washing the combustion residues in the ash discharger in which the combustion residues are built up in the fall shaft by suitable regulation of the discharge rate, the washing liquid flowing downward through combustion residues.

2. The process according to claim 1, wherein the solid combustion residues are built up beyond the water level in the fall shaft.

3. The process according to claim 1, wherein a chemical is used for washing.

4. The process according to claim 3, wherein said chemical is an acid.

5. The process according to claim 1, including the step of feeding fresh water or a chemical at the discharge end of the ash discharger in a counterflow to the washing liquid flowing down through the combustion residues.

6. The process according to claim 5, wherein the chemical is a base.

7. The process according to claim 5, wherein the chemical is a phosphate compound.

8. The process according to claim 1, including the step of drawing off the ash discharger water which is present in the ash discharger and which is charged with washed out products at the liquid surface adjusted at the lower end of the fall shaft within the region defined by the fall shaft.

9. The process according to claim 8, utilizing a draw-off rate enabling solid particles with particle diameters of up to 2 mm to be carried away.

10. The process according to claim 8, wherein at least a portion of the drawn off ash discharger water is returned to circulation in the fall shaft for washing the combustion residues.

11. The process according to claim 8, wherein the combustion residues falling through the furnace grate are mixed with the ash discharger water drawn off at the lower end of the fall shaft.

12. The process according to claim 1, including the step of drawing off the ash discharger water present in the ash discharger and which is charged with washed out products out of the ash discharger.

13. The process according to claim 12, utilizing a draw-off rate enabling solid particles with particle diameters of up to 2 mm to be carried away.

14. The process according to claim 12, wherein the ash discharger water which is charged with washed out products is fed to a waste gas purification device arranged downstream of the combustion process after being drawn out of the ash discharger.

15. The process according to claim 12, wherein the ash discharger water which is charged with washed out products is fed to a washing stage for neutralizing acidic waste gases formed in the combustion process after being drawn out of the ash discharger.

16. The process according to claims 12, wherein the combustion residues falling through the furnace grate are mixed with the ash discharger water drawn off from the region of the ash discharger.

17. The process according to claim 1, wherein the amount of washing liquid fed into the region of the upper end of the fall shaft is 0.2 to 20 $m^3$ per ton of combustion residues.

18. The process according to claim 1, wherein the amount of washing liquid fed in the counterflow at the push-out end of the ash discharger is 0.2 to 4 $m^3$ per ton of combustion residues.

19. An arrangement for carrying out the process of claim 1, comprising:

an ash discharger in which a device is provided in the region of the upper end of a fall shaft for supplying washing liquid, said fall shaft having a cross-sectional area in said region of the upper end, said device distributing the washing liquid over said cross-sectional area of said fall shaft.

20. An arrangement according to claim 19, wherein the device for supplying washing liquid comprises spray nozzles which are provided in the side walls of the fall shaft.

21. An arrangement according to claim 19, wherein the device for supplying washing liquid includes perforated pipes traversing the fall shaft.

22. An arrangement according to claim 19, for carrying out the process of claim 3, wherein the ash discharger comprises a push-out chute, a push-out ram and a fall shaft, said push-out chute and said push-out ram being formed of a material which is wear-resistant but not acid-resistant and said fall shaft being formed of an acid-resistant material.

23. The arrangement according to claim 19, wherein said ash discharger comprises a push-out chute and a push-out ram, said push-out ram for pushing combustion residues up said push-out chute at a push-out side of said ash discharger, wherein spray nozzles for fresh water or washing liquid in the form of a chemical, such as a base or phosphate compounds, are provided at said push-out side of the ash discharger to provide uniform distribution of the washing liquid to the combustion residues located on the push-out chute.

24. The arrangement according to claim 19, wherein the ash discharger is connected with a settling tank through the means of a draw-off duct proceeding from the surface of the liquid within the fall shaft.

25. The arrangement according to claim 24, wherein the settling tank is connected to a collecting hopper through valves for combustion residues falling through the furnace grate.

26. The arrangement according to claim 19, wherein the ash discharger is connected with a setting tank through the means of a draw-off duct proceeding from the surface of the liquid within the fall shaft.

27. The arrangement according to claim 19, wherein the ash discharger is connected with a hermetically sealed setting tank via a draw-off duct proceeding from the surface of the liquid within the ash discharger.

* * * * *

UNITED STATES PATENT AND TRADEMARK OFFICE
CERTIFICATE OF CORRECTION

| | | |
|---|---|---|
| PATENT NO. | : | 5,711,233 |
| ISSUED | : | January 27, 1998 |
| INVENTOR(S) | : | Johannes J.E. Martin et al |

It is certified that this error appears in the above-identified patent and that said Letters Patent is hereby corrected as shown below:

Column 3, line 15, change "pans" to --parts--;

Column 6, line 3, change "pans" to --parts--.

Signed and Sealed this

Twenty-first Day of July, 1998

*Attest:*

Bruce Lehman

BRUCE LEHMAN

*Attesting Officer*

*Commissioner of Patents and Trademarks*